US007007923B2

(12) United States Patent
Dorigo et al.

(10) Patent No.: US 7,007,923 B2
(45) Date of Patent: Mar. 7, 2006

(54) VALVE UNIT FOR CONTROLLING THE DELIVERY OF A FUEL GAS

(75) Inventors: Roberto Dorigo, Caorle (IT); Massimo Giacomelli, Mirano (IT); Stefano Zanella, Montebelluna (IT)

(73) Assignee: Sit La Precisa S.p.A., Padua (IT)

( * ) Notice: Subject to any disclaimer, the term of this patent is extended or adjusted under 35 U.S.C. 154(b) by 0 days.

(21) Appl. No.: 10/491,996

(22) PCT Filed: Mar. 5, 2002

(86) PCT No.: PCT/IT02/00138

§ 371 (c)(1),
(2), (4) Date: Apr. 7, 2004

(87) PCT Pub. No.: WO03/031875

PCT Pub. Date: Apr. 17, 2003

(65) Prior Publication Data

US 2004/0245487 A1 Dec. 9, 2004

(30) Foreign Application Priority Data

Oct. 10, 2001 (IT) ..... PD2001A0240

(51) Int. Cl.
*F16K 31/02* (2006.01)

(52) U.S. Cl. ..... 251/129.11; 251/69; 251/71; 251/129.09

(58) Field of Classification Search ..... 251/68–71, 251/129.09–129.11
See application file for complete search history.

(56) References Cited

U.S. PATENT DOCUMENTS

| | | | |
|---|---|---|---|
| 2,268,960 A | 1/1942 | Ray | |
| 2,873,069 A | 2/1959 | Matthews | |
| 2,875,773 A | 3/1959 | Matthews | |
| 6,572,076 B1 * | 6/2003 | Appleford et al. | 251/69 |

FOREIGN PATENT DOCUMENTS

| | | |
|---|---|---|
| EP | 0 035 154 | 9/1981 |
| EP | 1 106 923 | 6/2001 |

* cited by examiner

*Primary Examiner*—David J. Walczak
*Assistant Examiner*—Peter deVore
(74) *Attorney, Agent, or Firm*—Merchant & Gould P.C.

(57) ABSTRACT

A valve unit for controlling the delivery of a fuel gas through a delivery duct (3) comprises a valve seat (6) in the duct, a closure member (5) associated with the seat, a motor-driven actuator (7) acting on the closure member in order to control it so as to open/close the valve seat, as well as an electromagnetic unit (22) with a first portion (23) carrying a magnetizing winding (24) and a second portion (25) which can be fixed firmly to the first position by magnetization. The electromagnetic unit (22) is associated with the actuator in order to act on the closure member (5) so as to close the valve seat (6), irrespective of the operative position of the actuator (7), upon the occurrence of a predetermined condition which requires the valve seat to be shut off, and the actuator means (7) is movable, together with the second portion (25) of the electromagnetic unit (5) so as to open/close the valve seat, the first portion (23) of the electromagnetic unit being connected to a stationary structure of the valve unit.

12 Claims, 1 Drawing Sheet

VALVE UNIT FOR CONTROLLING THE DELIVERY OF A FUEL GAS

TECHNICAL FIELD

The present invention relates to a valve unit for controlling the delivery of a fuel gas according to the preamble to main claim 1.

TECHNOLOGICAL BACKGROUND

Valve units having the characteristics indicated above are typically provided for controlling the delivery of fuel gas to a burner or other similar user device for the controlled regulation of its delivery pressure or of the flow-rate of gas supplied.

Valve units of this type are known from the Applicant's own production; such a valve unit typically has a motor-driven actuator for the operative control of a closure member so as to open and close a valve seat formed in the delivery duct. For example, for the control of the closure member, it is known to provide a rod which is connected to the rotor of an electric motor by means of a male-and-female screw coupling in order to move the closure member away from and towards the valve seat as a result of a rotation of the motor. By rotation of the actuator, it is also possible to achieve modulation control of the delivery pressure or of the flow-rate of gas delivered.

To ensure safety closure of the valve seat upon the occurrence of predetermined conditions, for example, in order to shut off the passageway for the gas as a result of the interruption of electrical supply to the motor-driven actuator (in which condition the actuator may stop in an intermediate position of opening of the valve seat), a solution has been provided by the prior art and forms the subject of the Applicant's Italian patent No. PD99A000274. This provides for the use of an electromagnetic unit interposed between the closure member and the main motor-driven actuator and arranged to act on the closure member so as to close the valve seat, by virtue of the resilient force exerted by a spring in opposition to the electromagnetic attraction between the stationary core and the movable armature of an electromagnet of the electromagnetic unit. If conditions arise which require the valve seat to be shut off, the interruption of the electrical supply to the electromagnet brings about the safety closure movement of the closure member, under the action of the above-mentioned resilient force, irrespective of the operative position adopted by the actuator.

Although, on the one hand, this solution is extremely reliable in ensuring the safety closure of the valve seat, on the other hand, it leads to some structural complexity connected mainly with the presence of an electromagnet which floats with the control rod of the closure member and, in particular, which floats inside a region affected by the gas flow. This configuration in fact requires the provision of specific conditions of electrical insulation as well as of sealing with respect to the gas, both of the electrical contacts and of the wires for supplying the electromagnet, which conditions are more difficult to satisfy with an electromagnet which is movable inside the valve unit.

DESCRIPTION OF THE INVENTION

One of the main objects of the present invention is to provide a valve unit which is designed structurally and functionally to overcome all of the limitations discussed with reference to the prior art mentioned.

This and other objects which will be explained further below, are achieved by the invention, by means of a valve unit formed in accordance with the is appended claims.

BRIEF DESCRIPTION OF THE DRAWINGS

The characteristics and the advantages of the invention will become clearer from the following detailed description of a preferred embodiment thereof, described by way of non-limiting example with reference to the appended drawings, in which.

PREFERRED EMBODIMENT OF THE INVENTION

Figures 1, 2, 3:
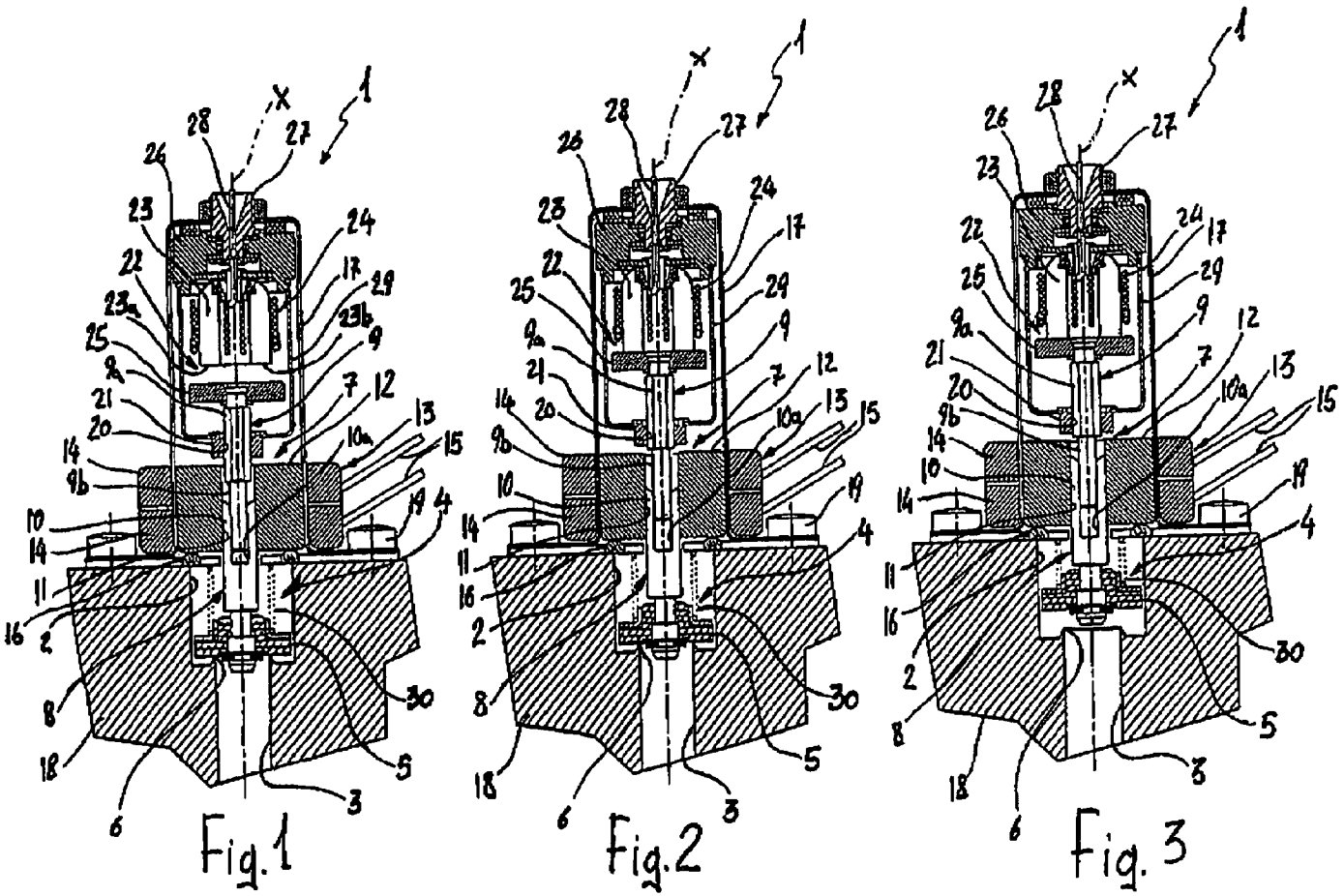
FIGS. 1 to 3 are longitudinal sections through a valve unit according to the invention in respective different operative conditions.

In the drawings mentioned, a valve unit for controlling the delivery of a fuel gas to a burner or other similar user device, not shown in the drawings, formed in accordance with the present invention, is generally indicated 1. The gas is supplied to the unit 1 through a supply duct 2 shown partially in the drawings, and is delivered thereby through a delivery duct 3.

The valve unit 1 comprises a modulation valve 4 including a plate closure member 5 which is acted on so as to close a valve seat 6 formed between the ducts 2 and 3. The unit also comprises a motor-driven actuator, generally indicated 7, including a rod 8, of longitudinal axis X, for operating the closure member 5.

The operating rod 8 comprises two structurally independent, coaxial portions 9, 10 forming extensions of one another and interconnected by means of a male-and-female screw coupling.

More particularly, the first portion 9 of the rod has a first portion 9*a* with an outer wall of hexagonal profile, extended axially by a second, externally threaded portion 9*b*, coaxial therewith.

The portion 9*b* is screwed into a threaded hole 10*a* formed axially starting from one end of the second portion 10 of the rod. At its opposite end, the rod is connected to the closure member 5 by means of a conventional swinging connection.

The second rod portion 10 has an outer wall with a cross-section having a polygonal (for example, hexagonal) profile, which is engaged so as to be freely slidable axially (along the axis X) in a through-hole 11 of corresponding profile formed centrally in a rotor 12 of an electric motor 13 with a hollow shaft. The motor 13 is a direct-current motor and is advantageously a reversible stepping motor in which the suitably-polarized permanent-magnet rotor 12, is surrounded circumferentially by one or more coils 14 supplied by electrical wires 15. The coils 14 are intended to create the rotating magnetic field necessary to rotate the rotor. The rotor is supported axially by thrust bearings 16, which are shown schematically, whereas the coils 14 are fitted on a cylindrical, bell-like casing 17 constituting a housing for the rotor 12 and suitably fixed to a stationary structure 18 of the unit by means of screws 19, with the interposition of means for sealing the bell 17 onto the structure 18 in a gas-tight manner.

The first rod portion 9 is engaged, so as to be freely slidable axially, in a through-hole 20 of corresponding hexagonal profile formed in a bush 21 which also constitutes a bearing support for the motor at the end axially remote from the thrust bearing 16.

The casing 17 also houses an electromagnetic unit, generally indicated 22, comprising an electromagnet with a first portion or stationary core 23 carrying a magnetizing winding 24, and a second portion or movable armature 25 which can be fixed firmly to the stationary core by magnetization. The unit 22 may advantageously comprise an ordinary magnetic unit or a low-consumption holding magnet.

The stationary core portion 23 of the electromagnet is U-shaped with opposed arms 23*a*, 23*b*, on which the winding 24 is provided, and is fixed to the casing 17 by means of a support 26 carrying a threaded shank-like element 27. The shank is perforated centrally for the insertion of electrical wires 28 for supplying the electromagnet.

The movable armature portion 25 of the electromagnet is connected to the end of the first rod portion 9 remote from the threaded portion 9*b*.

It will be noted that the armature 25 is the only part of the electromagnet which is movable with the operating rod 8, since the portion carrying the winding of the electromagnet is connected rigidly to the stationary structure 18 of the valve unit.

The electromagnet of the electromagnetic unit is also housed, as a whole, in a substantially cylindrical capsule 29 mounted coaxially inside the casing 17 and extending axially between the support 26 and the bush 21.

A spring, indicated 30, acts between the stationary structure 18 of the valve unit and the closure member 5 in order to act on the closure member so as to close the valve seat 6 as well as to take up the play in the male-and-female screw coupling.

In operation, in an initial condition, shown in FIG. 1, in which the passageway for the gas is shut off, the valve seat 6 is closed by the closure member 5 as a result of the resilient action of the spring 30, the electromagnet of the actuator 22 is de-energized, and the motor 13 is consequently not supplied with energy.

Starting from this condition, the motor is arranged to be operated initially for a predetermined number of turns which is correlated, by means of the pitch of the thread in the male-and-female screw coupling, with a predetermined axial travel of the first rod portion 9. The travel performed by this rod portion is such as to bring the movable armature 25 to a position close to the stationary core of the electromagnet, in the vicinity of the region of electromagnetic attraction. Subsequent excitation of the electromagnet by means of a suitable electrical supply to the solenoid winding 24 leads to the generation of an electromagnetic-attraction force which can keep the armature 25 anchored to the stationary core 23 in the position shown in FIG. 2.

A subsequent rotation of the motor 13 in the opposite direction to the previous rotation brings about screwing of the second rod portion 10 onto the first portion 9, causing axial sliding of the second portion 10 and consequent movement of the closure member 5 away from the seat 6, in opposition to the spring 30, and corresponding opening of the valve seat. According to the number of turns performed by the motor, the travel of the closure member 5 can be regulated to permit modulation control of the delivery pressure. FIG. 3 shows a normal-operation condition in which the travel of the second rod portion 10 is correlated with the rotation of the motor 13 to permit modulation control in the valve unit.

Upon the occurrence of predetermined conditions which require the valve seat 6 to be shut off, the electrical supply to the solenoid 24 of the electromagnet is interrupted and the closure member 5 is consequently acted on by the spring 30 so as to close the seat 6, irrespective of the position of the operating rod. The rod is guided axially during the closure of the valve seat by relative sliding between the first rod portion 9 and the bush 21 and between the second rod portion 10 and the rotor 12.

It is also pointed out that the spring 30 is selected so as to have dimensions and a spring constant such as to ensure safety closure of the closure member 5 against the valve seat 6, starting from any axial position reached by the operating rod 8 during the modulation function.

In addition to the function of modulation of the delivery pressure and/or of the gas flow-rate, the same modulation valve 4 thus also performs the function of safety closure of the passageway for the gas through the valve seat 6. The valve ensures a low-consumption modulation function and high-resolution positioning, in any case ensuring the safety closure function with a high closure load and rapid intervention times, upon the occurrence of predetermined conditions.

The invention thus achieves the objects proposed, affording many advantages over known solutions.

A principal advantage lies in the fact that, by virtue of the provision of an electromagnetic unit without any moving parts of the electromagnetic winding, the electrical supply of the valve unit according to the invention is made easier and electrical insulation and sealing relative to the gas portion are rendered less complex.

Another advantage is that the invention provides an electromagnetic unit with smaller moving inertial masses and consequently a lower energy requirement during the operation of the modulation valve, both in the actual modulation stage and during the safety closure of the valve.

Another advantage lies in the fact that the motor-driven actuator and the electromagnetic unit, which are coaxial with one another, lead to a greater overall compactness which also advantageously enables them to be housed in a single casing, closed off from the gas portion of the valve in a leaktight manner.

Yet another advantage is connected with the structural simplicity of the valve unit according to the invention, which requires fewer components than known solutions. These components may also be provided with preselected modularity to permit the modulation control and safety closure of valve seats of different sizes.

Not the least advantage is improved overall reliability of the valve unit formed in accordance with the invention.

What is claimed is:

1. A valve unit for controlling the delivery of a fuel gas through a delivery duct, the valve unit comprising:

a valve seat located in the duct, a closure member associated with the valve seat, a motor-driven actuator acting on the closure member, having:

a rod for operating the closure member, wherein the actuator controls the closure member to open or close the valve seat, an electromagnetic unit associated with the actuator having:

a first portion having a magnetizing winding, wherein the first portion is connected to a stationary structure of the valve unit, and a second portion having a movable armature mounted on one end of the rod, wherein the second portion is configured to be firmly fixed to the first portion by magnetization, wherein the actuator and the second portion of the electromagnetic unit move together, and the movement opens or closes the valve seat.

2. A valve unit according to claim 1 wherein the motor-driven actuator and the electromagnetic unit are mounted coaxially with the valve seat.

3. A valve unit according to claim 1 wherein the operating rod comprises a first portion and a second portion forming axial extensions of one another and are connected to one another by a male-and-female screw coupling, and wherein the rod portions are connected at their free ends to the armature and to the closure member respectively.

4. A valve unit according to claim 3 wherein the second rod portion is fixed firmly to a rotor of an electric motor.

5. A valve unit according to claim 4 wherein the second rod portion is engaged in a hollow shaft of the rotor and is freely slidable axially relative thereto.

6. A valve unit according to claim 4, comprising guide means for gliding the first rod portion axially during the operation of the closure member as a result of rotation of the rotor about its own axis.

7. A valve unit according to claim 6 wherein the guide means comprises a bush slidably engaged with the first rod portion, and wherein rotation-prevention means are provided between the bush and the first rod portion.

8. A unit according to claim 7 wherein the rotation-prevention means comprise a wall with a polygonal profile in the first rod potion and are housed in a through-hole of the bush having a cross-section of a corresponding profile.

9. A valve unit according to claim 4 wherein the motor is a direct-current stepping motor.

10. A valve unit according to claim 4 wherein the rotor is of a suitably-polarized permanent-magnet type.

11. A valve unit according to claim 4 wherein the electromagnetic unit and the rotor are housed in a casing connected to the stationary structure of the valve unit in a gas-tight manner.

12. A valve unit according to claim 4, the valve further comprising electrical coils for controlling the rotor, wherein the coils are fitted on the casing externally in the region of the rotor.

* * * * *